US007997624B2

(12) United States Patent
Charell

(10) Patent No.: US 7,997,624 B2
(45) Date of Patent: Aug. 16, 2011

(54) MORE STIMULATING RIDING VEHICLES

(76) Inventor: Ralph Charell, New York, NY (US)

( * ) Notice: Subject to any disclaimer, the term of this patent is extended or adjusted under 35 U.S.C. 154(b) by 368 days.

(21) Appl. No.: 12/189,242

(22) Filed: Aug. 11, 2008

(65) Prior Publication Data

US 2009/0039636 A1 Feb. 12, 2009

Related U.S. Application Data

(60) Provisional application No. 60/964,236, filed on Aug. 10, 2007.

(51) Int. Cl.
*A63C 17/00* (2006.01)

(52) U.S. Cl. ..... 280/841; 280/11.221; 280/11.223

(58) Field of Classification Search ..... 280/7.13, 280/7.15, 841, 11.15, 11.19, 11.221, 11.223, 280/11.231

See application file for complete search history.

(56) References Cited

U.S. PATENT DOCUMENTS

| | | | | | |
|---|---|---|---|---|---|
| 1,037,686 | A | * | 9/1912 | Toomey | 152/306 |
| 1,096,842 | A | * | 5/1914 | Kelly | 152/300 |
| 1,694,162 | A | * | 12/1928 | Buitenkamp | 280/844 |
| 3,512,602 | A | * | 5/1970 | Bertelsen | 180/164 |
| 3,671,051 | A | * | 6/1972 | Werft | 280/844 |
| 4,045,046 | A | * | 8/1977 | Taylor et al. | 280/87.042 |
| 4,398,735 | A | * | 8/1983 | Evans et al. | 280/11.28 |
| 4,434,992 | A | * | 3/1984 | Beach-Thomas | 280/47.331 |
| D293,562 | S | * | 1/1988 | Fuzioka et al. | D12/576 |
| 4,842,086 | A | * | 6/1989 | Michna | 180/9.1 |
| 5,246,238 | A | * | 9/1993 | Brown | 280/11.204 |
| 5,346,231 | A | * | 9/1994 | Ho | 280/11.208 |
| 5,390,958 | A | * | 2/1995 | Soo | 280/844 |
| 5,411,277 | A | * | 5/1995 | Pratt | 280/11.232 |
| 5,527,100 | A | * | 6/1996 | O'Donnell et al. | 301/5.309 |
| 5,580,096 | A | * | 12/1996 | Freilich | 280/844 |
| 5,720,529 | A | * | 2/1998 | Barron | 301/5.23 |
| 6,019,378 | A | * | 2/2000 | Cushing | 280/11.209 |
| D423,417 | S | * | 4/2000 | Liao | D12/576 |
| 6,135,568 | A | * | 10/2000 | Huang | 301/5.304 |
| 6,241,264 | B1 | * | 6/2001 | Page | 280/11.19 |
| 6,260,861 | B1 | * | 7/2001 | Chiang et al. | 280/11.221 |
| 6,290,242 | B1 | * | 9/2001 | Ludwig | 280/11.233 |
| D466,963 | S | * | 12/2002 | Forrest | D21/788 |
| 6,578,930 | B1 | * | 6/2003 | Alderman et al. | 301/5.303 |
| 6,698,776 | B2 | * | 3/2004 | Todd | 280/87.042 |
| 6,863,283 | B1 | * | 3/2005 | Houston et al. | 280/11.225 |
| D506,969 | S | * | 7/2005 | Thompson | D12/501 |
| 6,991,296 | B2 | * | 1/2006 | Back | 301/5.301 |
| 7,311,318 | B1 | * | 12/2007 | Funk | 280/87.042 |
| D571,863 | S | * | 6/2008 | On | D21/424 |
| D580,132 | S | * | 11/2008 | Lin | D2/946 |
| 2010/0253057 | A1 | * | 10/2010 | Arbogast | 280/844 |

* cited by examiner

*Primary Examiner* — J. Allen Shriver, II
*Assistant Examiner* — James Triggs
(74) *Attorney, Agent, or Firm* — Ladas & Parry LLP

(57) ABSTRACT

A non-motorized Riding Vehicle for transport of a rider on a surface. The Riding Vehicle includes a shoe body or platform for supporting at least one foot of the rider during the transport and at least one Riding Element under the shoe body or platform that rotates on an axle to facilitate the transport while supporting the rider. The at least one Riding Element includes stimulating elements for creating a periodic vibration during the transport that makes the transport on the surface less smooth than the transport would be if the at least one Riding Element did not include the stimulating elements. Also, a kit and method for converting the Riding Vehicle to a Riding Vehicle with a more or less (intense) vibratory ride.

19 Claims, 17 Drawing Sheets

MORE STIMULATING RIDING VEHICLES

This application claims the benefit of U.S. Provisional Application No.: 60/964,236 filed Aug. 10, 2007 and incorporates the same by reference.

FIELD OF THE INVENTION

The Invention (the "Invention") disclosed in this application consists of a number of discrete parts and involves roller skates (both quads and in-line), skateboards, scooters, and other riding vehicles (the "Riding Vehicles" and each a "Riding Vehicle") that employ, for example, without limitation, novel and innovative tires, wheels, rollers, ball bearings, roller bearings, spindles, and tractor and tank-like treads ("Riding Elements" and each a "'Riding Element") with the general objective of creating and delivering to riders a wide choice of more stimulating riding experiences on Riding Vehicles.

BACKGROUND OF THE INVENTION

An extremely large international public of men, women and children have enjoyed recreational roller-skating for decades. However, notwithstanding the introduction of a number of modifications to, for example, skate tires such as, for examples, their size, configuration, number, the materials of which they are constituted, and the manufacturing methods employed in their production, the riding public on conventional quad and in-line skate tires (as well as on the tires of conventional skateboards and scooters) still travel along a relatively smooth riding surface and receive a relatively smooth ride. Indeed, a smooth ride has long been widely promoted as a feature of the riding experience among such riders and the delivery of a smooth (and even a smoother) ride by various means is a principal objective to be found in the claims of several patents.

SUMMARY OF THE INVENTION

Reinventing the Wheel and Changing the Game For a More Stimulating Ride

In a departure from the quest for an ever smoother ride, a principal objective of the Invention is to create and deliver a ride less smooth; i.e., a more stimulating ride (a "More Stimulating Ride"), a pleasant stimulating, salubrious ride that provides massaging action that can be varied from gentle to intense. Such ride is unavailable on conventional quads and in-line skates, skateboards, scooters, or on other conventional Riding Vehicles.

The objectives of the Invention involve, broadly, Riding Vehicles, although the principal embodiments described in greater detail herein emphasize quads and in-line skates, skateboards, and scooters.

Another objective of the Invention is to provide such More Stimulating Ride without the use of a power source and hence to deliver a safer, cleaner ride and a ride less expensive for a manufacturer to produce and for riders to maintain.

Power sources provided by batteries, motors, electrical, electronic, and electromagnetic means involve inherent, associated, foreseeable risks of personal injury owing to their heat buildup as well as to the nature of the particular power source. Such power sources add unnecessary liability and production costs to the sell side, unnecessary risk of injury, initial and maintenance costs and extra weight for the rider, and put an unnecessary and undesirable waste disposal burden on the environment.

The Invention eliminates such liability, costs, risk of injury, excess weight and environmental burden and enhances and broadens the market for the manufacturer (as set forth in greater detail below) while economically delivering a number of innovative benefits and advantages to riders.

Another objective of the Invention involves the creation of unique sounds emitted in its use. In producing a particular More Stimulating Ride on a particular Riding Vehicle, the Invention concomitantly produces a pleasant, distinctive, unique sound pattern unlike that of conventional Riding Vehicles. Such unique sound patterns will vary with the particular Riding Vehicle, its starts and stops, the surface on which it goes and its variations in velocity and are caused by the repetitive and rhythmic alternation of sounds during the course of the More Stimulating Ride.

Another objective of the Invention is to enable skaters on conventional quads or in-line skates to receive the benefits and enjoyment of a More Stimulating Ride on an appropriately constructed, novel and innovative roller skating rink (the "Rink") or other riding surface covered with closely-spaced short ribs, grooves or rounded protrusions dispersed, for example, concentrically, in straight lines or in other patterns so as to deliver to the rider a More Stimulating Ride.

Another objective of the Invention is to broaden the rider's choice of rides, to empower the rider to customize his or her ride on any particular occasion by enabling riders to adjust the amount of additional stimulation their ride will deliver as well as its velocity. The Invention achieves this objective by offering riders a number of different, innovative Riding Elements and a number of innovative convertible opportunities.

As an important first step in enabling riders to customize their More Stimulating Ride at and for their pleasure, the Invention's innovative tires are easily detached and attached. This permits a manufacturer with a product line that includes conventional quads, in-line skates, scooters and skateboards, and their tires (or any combination thereof), that also manufactures any of the Riding Vehicles disclosed herein, to make such conventional wheels and tires interchangeable with their counterparts offering the More Stimulating Ride, and vice versa.

A tool kit with instructions to facilitate such conversions may also be made available. By thus offering riders this convertible opportunity, such manufacturer may reasonably expect to broaden both the primary and secondary markets and its own market share.

Another objective of convertibility is to enable riders to choose the number of innovative Riding Elements they will substitute for their conventional counterparts on a particular ride, and vice versa, stimulating a brisk secondary market for the Invention. The more of the innovative Riding Elements in the initial purchase or substituted for their conventional counterparts on a particular ride, the more stimulating such ride will be.

An additional objective and consequence of convertibility is that, in addition to the delivery to the rider the Invention provides to alter the configuration and increase the number of tires a rider may choose to employ on a variety of Riding Vehicles, the rider is given greater freedom to choose his or her ride on a particular occasion, its particular quantum of stimulation, and its velocity. Some of the drawings below illustrate Riding Vehicles with the capacity to employ more than the conventional number of Riding Elements.

Another of the objectives of the More Stimulating Ride, its accompanying distinctive, unique sounds, and safe, economical, and wide choices of rides is to provide a number of intriguing combinations for skaters and other riders and intentionally to broaden the market as referenced above.

As another example of such broadening of the market, there are millions of would-be skaters of all ages worldwide who cannot safely enjoy in-line skating but who find quads too tame. These men, women and children no longer have to sit on the sidelines, risk injury, or seek their recreation elsewhere, as the Invention presents the opportunity for them to get off the bench and enjoy the benefits, advantages, stimulation and sheer fun of the More Stimulating Ride on quads. And for those riders adept at in-line skating, the Invention introduces a new level of benefits, advantages, and enjoyment and such opportunities are also introduced for skateboard and scooter riders.

Although no health claims are made for the Invention herein, it should be noted that there is credible evidence to the effect that the More Stimulating Ride would produce at least two such significant benefits; namely, improved blood circulation and increased bone density.

In accordance with the Invention there is provided a non-motorized Riding Vehicle for transport of a rider on a surface, wherein the Riding Vehicle comprises a shoe body or platform for supporting at least one foot of the rider during the transport and at least one Riding Element under the shoe body or platform that rotates on an axle to facilitate the transport while supporting the rider. The at least one Riding Element comprises stimulating means for creating a periodic vibration during the transport that makes the transport on the surface less smooth than the transport would be if the at least one Riding Element did not comprise the stimulating means.

In accordance with a preferred embodiment of the Invention, the Riding Vehicle is a device selected from the group consisting of an in-line skate, a quad skate, a skateboard and a scooter, the Riding Vehicle comprising a plurality of wheels or rollers including the at least one Riding Element. The periodic vibration creates a distinctive, unique, rhythmic, and/or repetitive sound during the transport. The sound created by the periodic vibration may be, for example, at least about 45 decibel at 60 rpm of the at least one Riding Element.

In accordance with another preferred embodiment of the Invention, the stimulating means can comprise one or more of the following:

i) one or more axial grooves around a perimeter of the at least one Riding Element;

ii) one or more radial projections around a perimeter of the at least one Riding Element;

iii) one or more rounded ridges spaced around a perimeter of the at least one Riding Element;

iv) one or more channels for ball or roller bearings disposed about a perimeter of the at least one Riding Element;

v) one or more ball bearings that protrude around a perimeter of the at least one Riding Element and radial projections around the perimeter on opposite sides of the ball bearings; or vi) any of the Riding Elements depicted in FIGS. 1-15 of the drawings.

In accordance with a further embodiment of the Invention, the at least one Riding Element is made of a material selected from the group consisting of plastic, rubber, metal and wood. In a preferred embodiment, the at least one, Riding Element is solid, i.e., it does not contain air.

In accordance with another embodiment of the Invention, there is provided a kit comprising:

a) a body of a Riding Vehicle having a top portion comprising a shoe or platform for supporting at least one foot of a rider and a bottom portion comprising axle means for receiving a number n of Riding Elements to facilitate transport of the rider with the rider's foot supported in the shoe or on the platform, wherein n is greater than or equal to 1; and b) a plurality of Riding Elements, each of which is insertable onto the axle means to facilitate transport of the rider on the Riding Vehicle, said plurality of Riding Elements comprising more than n Riding Elements whereby any of a plurality of different combinations of the n Riding Elements can be inserted onto the axle means, said plurality of Riding Elements comprising at least a first Riding Element with stimulating means for creating a first periodic vibration during the transport such that, when the first Riding Element is included in a combination of n Riding Elements on the axle means, the transport of the Riding Vehicle is less smooth than a transport when the first Riding Element is not included in the combination of n Riding Elements on the axle means.

In another embodiment, the plurality of Riding Elements of the kit further includes a second Riding Element with second stimulating means for creating a second periodic vibration during the transport, said second periodic vibration having a periodicity or intensity that is different than a periodicity or intensity of the first periodic vibration.

In a preferred embodiment of the kit, the Riding Vehicle is a non-motorized device selected from the group consisting of an in-line skate, a quad skate, a skateboard and a scooter.

In accordance with yet another embodiment of the Invention, there is provided a method for changing the stimulation provided by a Riding Vehicle, comprising the steps of:

a) providing a Riding Vehicle having a body comprising a shoe or platform for supporting a foot of a rider and at least one first Riding Element supporting the body to facilitate transport of the rider with the rider's foot in the shoe or on the platform; and b) replacing the first Riding Element of the Riding Vehicle with at least one replacement Riding Element comprising means for creating a periodic vibration such that the transport of the rider with the at least one replacement Riding Element replacing the first Riding Element is less smooth than the transport with the first Riding Element without the replacement Riding Element.

In a preferred embodiment of the method, the Riding Vehicle is a non-motorized device selected from the group consisting of an in-line skate, a quad skate, a skateboard and a scooter. In another embodiment of the method, the Riding Vehicle is provided with a plurality of Riding Elements including said first Riding Element and a second Riding Element, and said method further comprises replacing said replacement Riding Element or said second Riding Element with a second replacement Riding Element with second stimulating means for creating a second periodic vibration during the transport, said second periodic vibration having a periodicity or intensity that is different than a periodicity or intensity of the first periodic vibration.

In yet another embodiment of the Invention, there is provided a Rink for a Riding Vehicle comprising a pattern of closely spaced protruding ribs, shallow grooves or rounded ridges that produce a more stimulating ride for riders riding a conventional Riding Vehicle on the Rink.

In a still further embodiment of the Invention, there is provided a wheel of a Riding Vehicle comprising a solid portion that defines a central opening for insertion of the wheel onto an axle or bearing of the Riding Vehicle, the wheel comprising stimulating means for creating a periodic vibration of the Riding Vehicle. The wheel may be selected from any of the wheels depicted, for example, in FIGS. 1-15 of the drawings.

Higher-Speed, More Stimulating Riding

The more tires or other Riding Elements employed in a given embodiment of the Invention, the less weight each such Riding Element will bear. As a consequence, the less resistance each such tire or other Riding Element will meet, and accordingly, a faster More Stimulating Ride for a given effort will obtain. An objective of the Invention is to give riders the opportunity to vary the speed and stimulation of the ride, and to do so without having to incur the entire expense of additional skates, skateboards, scooters or other Riding Vehicles, by virtue of another convertibility feature described and referenced herein. Examples of some of these opportunities are illustrated below.

An example of this objective of the Invention involves the introduction of a new kind of "quad" skate that delivers higher-speed, higher-intensity stimulation. This "Super Quad" employs a third axle located between the two conventionally positioned quad axles on which third axle is attached a third pair of tires that may be of a type similar to any of the tires described herein and illustrated, for example, in FIGS. 1A, 2A, 3A, 4A, 5A and 6A, although its preferred embodiments are as found, for example, in FIGS. 1A and 2A. The other two pairs of tires would preferably match the tires selected; i.e., all six tires would preferably, but not necessarily, be as illustrated, for example, in FIG. 1A or FIG. 2A. The third axle and its tires may either be removable or fixed. If fixed, its tires may nevertheless be removed or changed.

This six tire "quad" thus introduces a higher-speed ride coupled with a higher-intensity level of stimulation. Additionally, the interchangeability of any and all of the innovative tires for conventional tires as described above would enable a rider to create his or her own customized higher-speed, More Stimulating Ride at and for his or her pleasure on a particular occasion.

Another example of higher-speed, more stimulating riding experiences offered by the Invention involves tires with one or more channels about an inner portion of their circumferences that contain ball or roller bearings and that also contain ridges near both edges of their circumference (that work in concert) as, for example, those described and illustrated in FIG. 5B so that riders may enjoy a higher-speed, More Stimulating Ride on a particular occasion.

BRIEF DESCRIPTION OF THE DRAWINGS

Preferred embodiments that illustrate but do not limit the Invention will now be described with reference to drawings thereof in which.

DETAILED DESCRIPTION OF THE PREFERRED EMBODIMENTS

Figure 1:
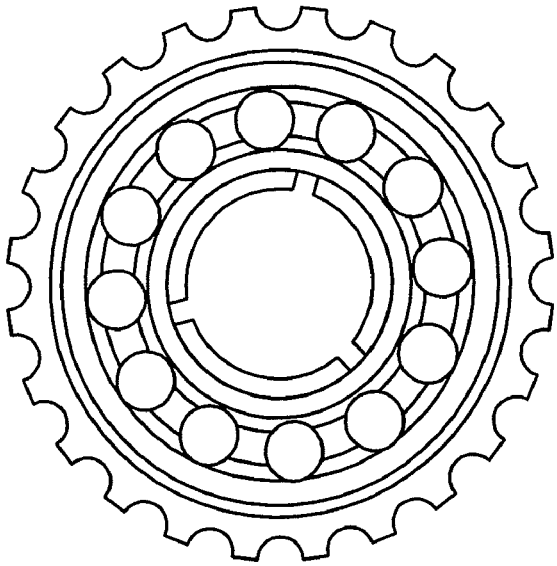
FIG. 1 is an axial elevational view of an embodiment of a wheel with a perimetric, tire-location surface having, for example, one or more axial grooves for the Invention.

The drawings illustrate some of the means of accomplishing the purposes succinctly set forth in the Abstract hereof. The preferred embodiments provide additional details in describing with reference to drawings that illustrate, but do not limit, the Invention in which:

FIG. 1 shows an axial elevational view of an embodiment of a wheel with a perimetric, tire-location surface having one or more axial grooves across the width of the wheel and about at least part of its circumference. Riding Vehicles, such as, for example quad skates or skateboards containing one or more of such wheels will produce a More Stimulating Ride than a ride on conventional wheels.

Figure 1A:
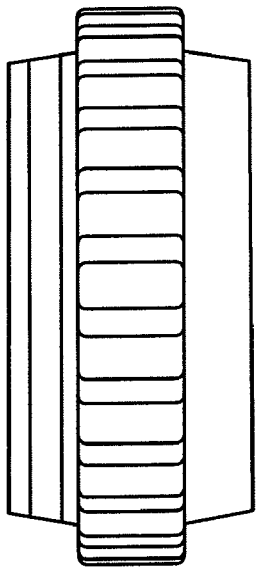
FIG. 1A is a front elevational view of the embodiment of FIG. 1, the rear elevational view being a mirror image and, therefore, not shown and the front and rear elevational views together showing all thereof.

FIG. 1A shows a front elevational view of an example of the embodiment of FIG. 1.

Figure 1B:
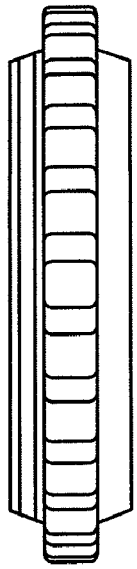
FIG. 1B is a front elevational view of another embodiment that is similar to that of FIG. 1A, but axially thinner.

FIG. 1B shows a thinner version of an example of the embodiment depicted in FIG. 1A that would provide a More Stimulating Ride on, for example, in-line skates and scooters.

Figure 2:
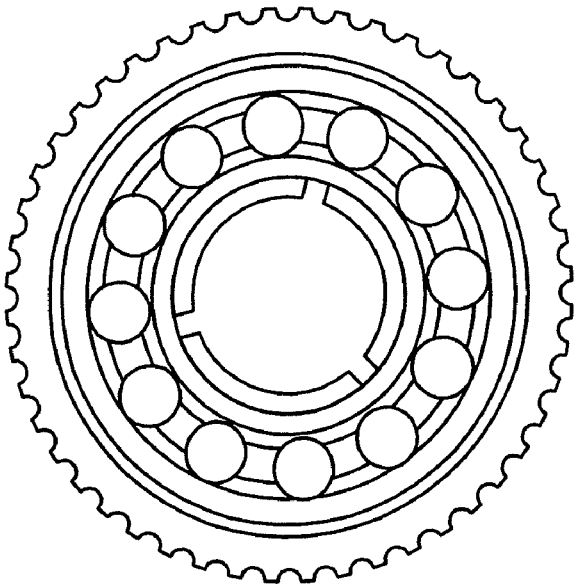
FIG. 2 is an axial elevational view of another embodiment of a wheel with a perimetric, tire-location surface for the Invention similar to that of FIG. 1, but having, for example, more axial grooves.

FIG. 2 is similar to FIG. 1 but contains more axial grooves such that it would produce a More Stimulating Ride of a different intensity and create a different sound pattern in its use.

Figure 2A:
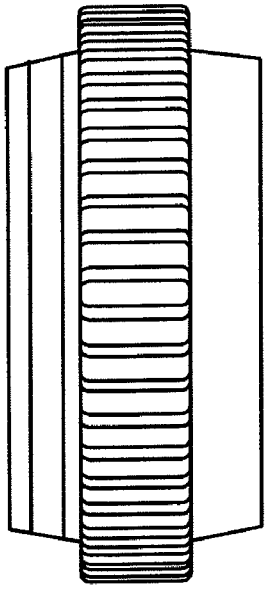
FIG. 2A is a front elevational view of the embodiment of FIG. 2, the rear elevational view being a mirror image and, therefore, not shown and the front and rear elevational views together showing all thereof.

FIG. 2A shows a front elevational view of the embodiment of FIG. 2, a wheel suitable for proving a More Stimulating Ride on quad skates and skateboards.

Figure 2B:
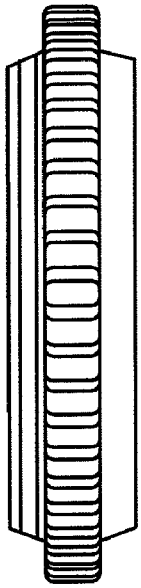
FIG. 2B is a front elevational view of another embodiment that is similar to that of FIG. 2A, but axially thinner.

FIG. 2B shows a thinner version of 2A that would be suitable for providing a More Stimulating Ride on, for example, in-line skates and scooters.

Figure 3C:
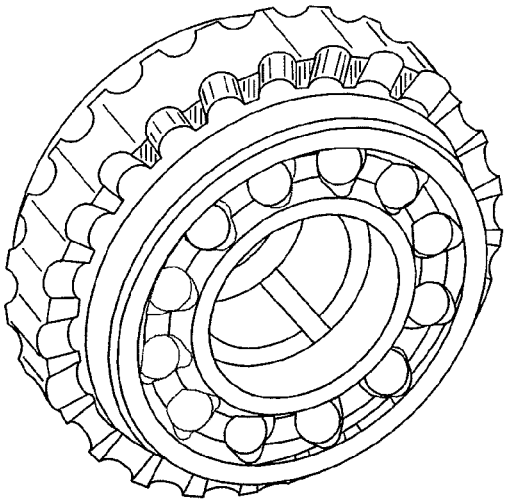
FIG. 3C is a top/right-side/front perspective view of the embodiment of FIG. 3.
Figure 3:
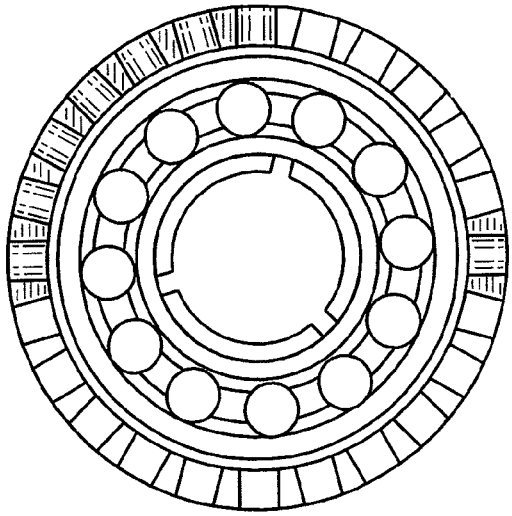
FIG. 3 is an axial elevational view of another embodiment of a wheel with perimetric, tire-location side surfaces having one or more radial projections for the Invention.

FIG. 3 illustrates another means of creating a More Stimulating Ride on Riding Vehicles, one or more of the wheels of which have one or more radial projections on both sides.

Figure 3A:
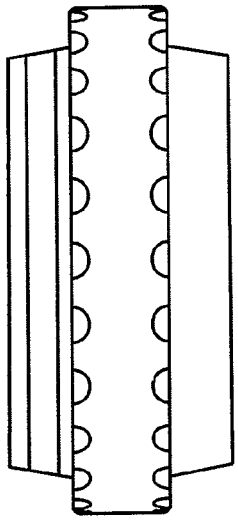
FIG. 3A is a front elevational view of the embodiment of FIG. 3, the rear elevational view being a mirror image and, therefore, not shown and the front and rear elevational views together showing all thereof.

FIG. 3A is a different view of FIG. 3C and illustrates a wheel that would produce a More Stimulating Ride on quads and skateboards.

Figure 3B:
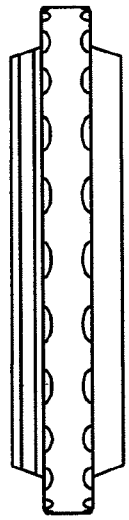
FIG. 3B is a front elevational view of another embodiment that is similar to that of FIG. 3A, but axially thinner.

FIG. 3B illustrates a thinner version of FIG. 3A that would be appropriate for scooters and in-line skates.

FIG. 3C is a perspective view of FIG. 3.

Figure 3D:
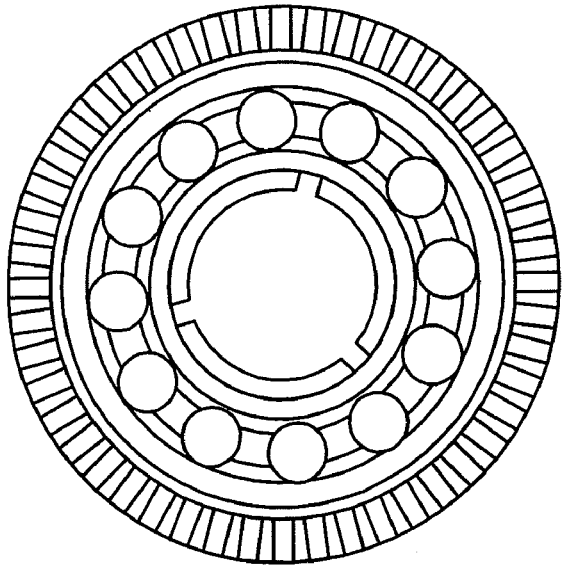
FIG. 3D is an axial elevational view of another embodiment of a wheel with perimetric, tire-location side surfaces for the Invention similar to that of FIG. 3, but having more radial projections.
Figure 3E:
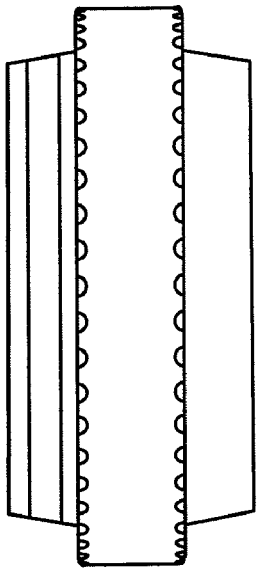
FIG. 3E is a front elevational view of the embodiment of FIG. 3D, the rear elevational view being a mirror image and, therefore, not shown and the front and rear elevational views together showing all thereof.
Figure 3F:
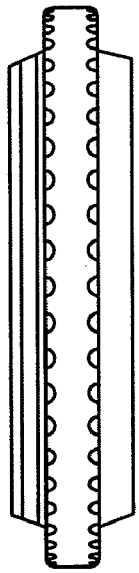
FIG. 3F is a front elevational view of another embodiment that is similar to that of FIG. 3E, but axially thinner.

FIGS. 3D, 3E and 3F have more radial projections than do their respective counterparts in FIGS. 3, 3A AND 3B and will produce a More Stimulating Ride of a different intensity and a different sound pattern in their use, but are otherwise analogous.

Figure 4:
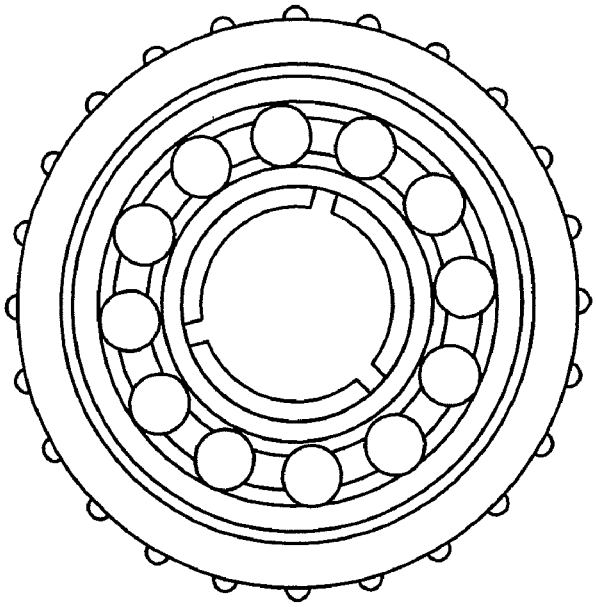
FIG. 4 is an axial elevational view of another embodiment of a wheel with a perimetric, tire-location surface having one or more radial projections axially thereacross for the Invention.
Figure 4A:
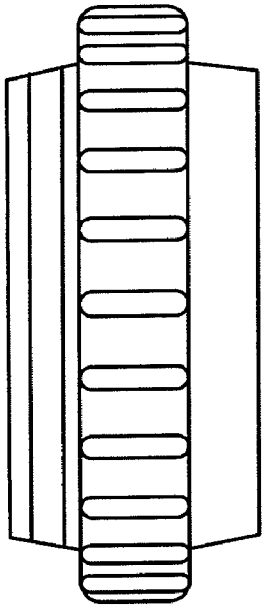
FIG. 4A is a front elevational view of the embodiment of FIG. 4, the rear elevational view being a mirror image and, therefore, not shown and the front and rear elevational views together showing all thereof.
Figure 4B:
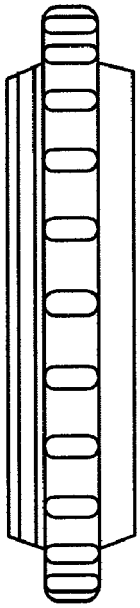
FIG. 4B is a front elevational view of another embodiment that is similar to that of FIG. 4A, but axially thinner.

FIGS. 4, 4A and 4B show another means of providing a More Stimulating Ride on Riding Vehicles using one or more wheels with one or more radial projections axially spaced across the riding surface of the wheel instead of axial grooves, as in FIGS. 2, 2A and 2B.

Figure 5C:
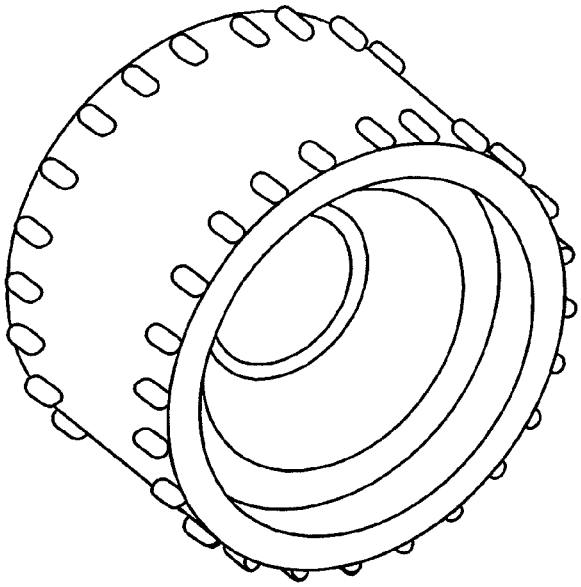
FIG. 5C is a top/right-side/front perspective view of the embodiment of FIG. 5.
Figure 5:
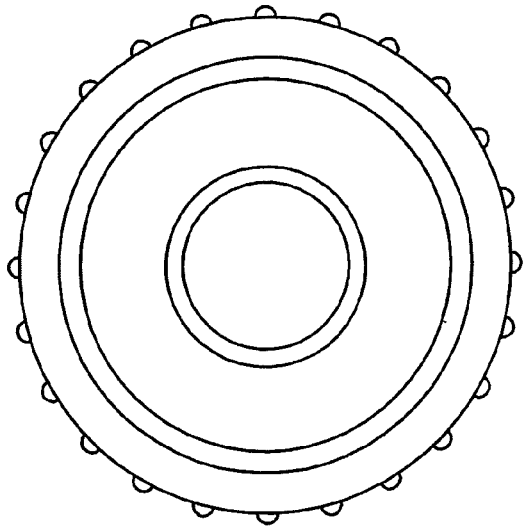
FIG. 5 is an axial elevational view of another embodiment of a wheel with a perimetric, tire-location surface having one or more axially spaced radial projections for the Invention.
Figure 5A:
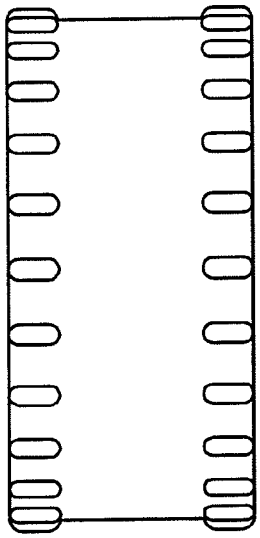
FIG. 5A is a front elevational view of the embodiment of FIG. 5, the rear elevational view being a mirror image and, therefore, not shown and the front and rear elevational views together showing all thereof.
Figure 5B:
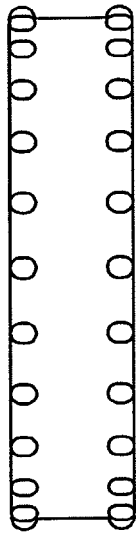
FIG. 5B is a front elevational view of another embodiment that is similar to that of FIG. 5A, but axially thinner.

FIGS. 5, 5A and 5B illustrate another means of providing a More Stimulating Ride on Riding Vehicles using one or more wheels with one or more axially spaced radial projections.

Figure 6:
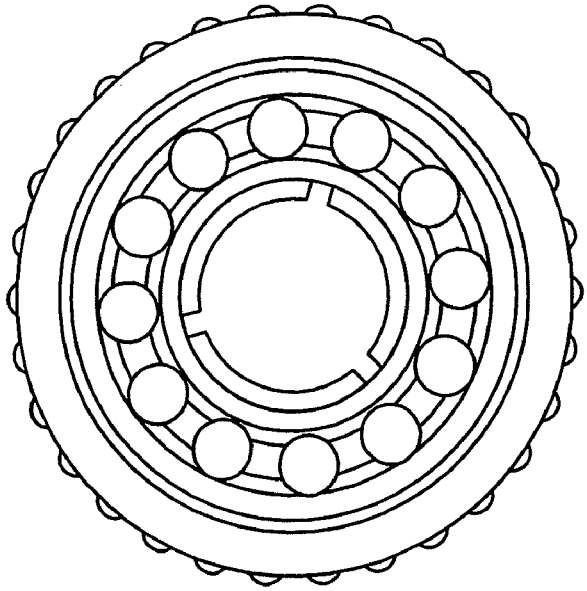
FIG. 6 is an axial elevational view of another embodiment of a wheel with a perimetric, tire-location surface having an axial pattern of one or more radial projections for the Invention.
Figure 6A:
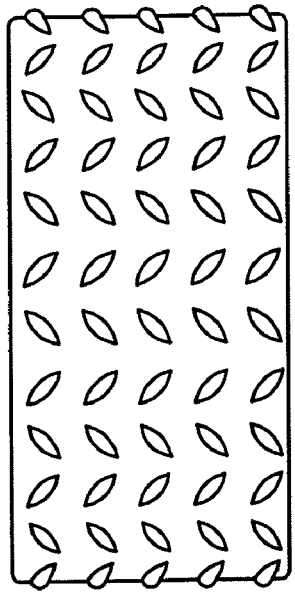
FIG. 6A is a front elevational view of the embodiment of FIG. 6, the rear elevational view being a mirror image and, therefore, not shown and the front and rear elevational views together showing all thereof.
Figure 6B:
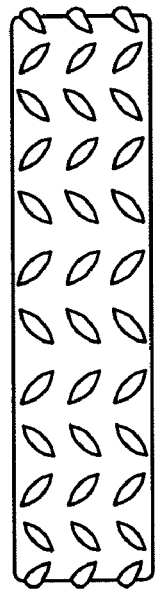
FIG. 6B is a front elevational view of another embodiment that is similar to that of FIG. 6A, but axially thinner.

FIGS. 6, 6A and 6B illustrate still another means of providing a More Stimulating Ride with an axial pattern of one or more radial projections on the riding surface of the wheel.

Figure 7:
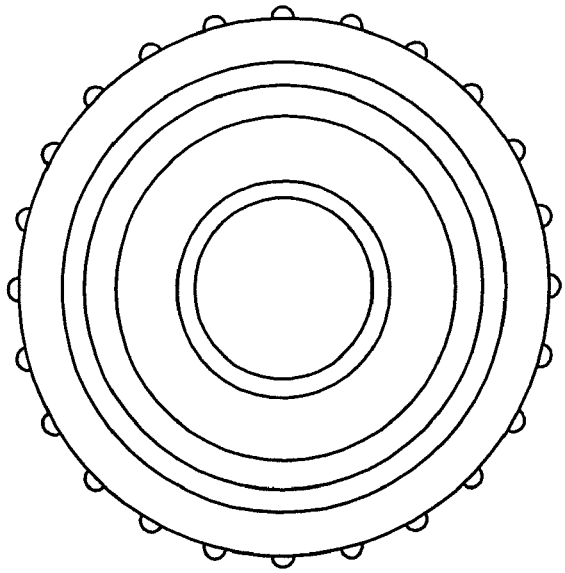
FIG. 7 is an axial elevational view of an embodiment of a roller with a perimetric, tire-location surface having another axial pattern of one or more radial projections for the Invention.
Figure 7C:
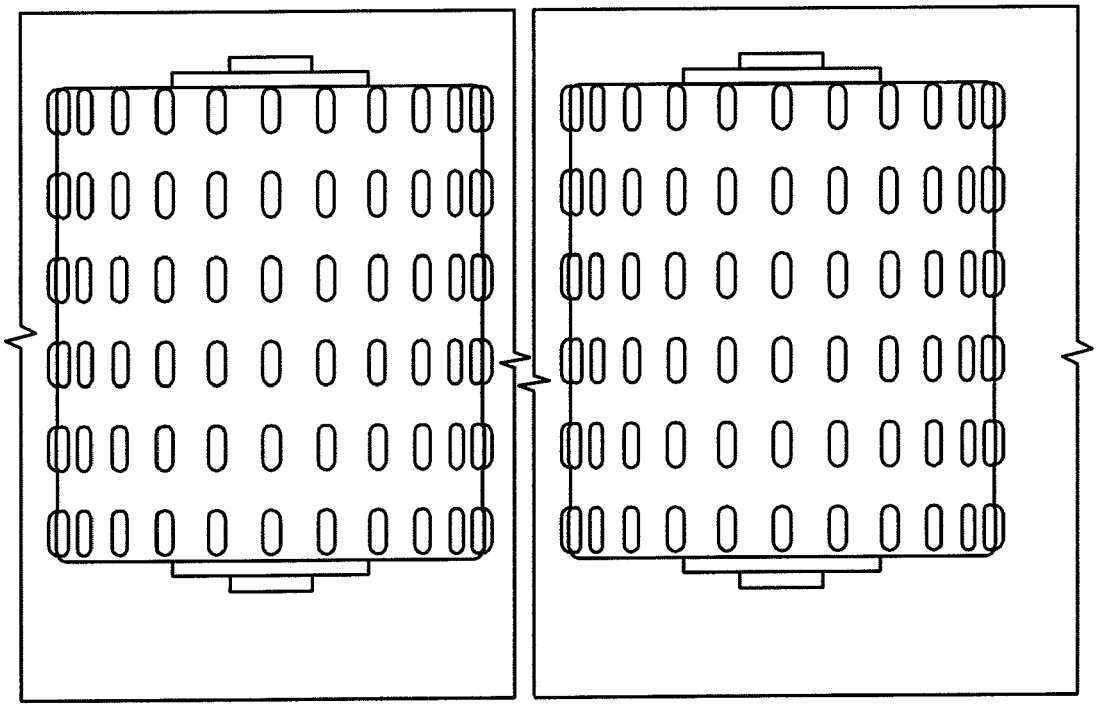
FIG. 7C is a bottom plan view of a schematically shown Riding Vehicle having front and rear rollers according to the embodiment of FIG. 7.
Figure 7B:
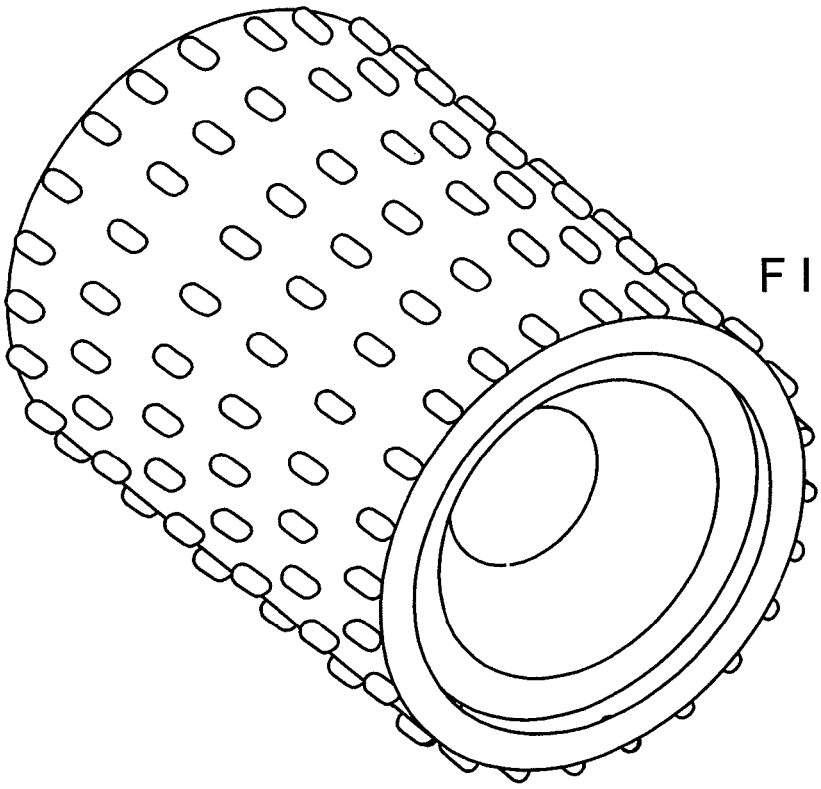
FIG. 7B is a top/right-side/front perspective view of the embodiment of FIG. 7.
Figure 7A:
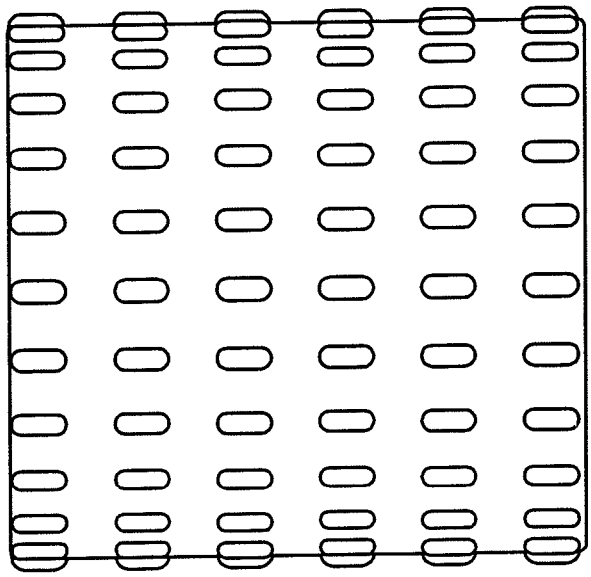
FIG. 7A is a front elevational view of the embodiment of FIG. 7, the rear elevational view being a mirror image and, therefore, not shown and the front and rear elevational views together showing all thereof.

FIGS. 7, 7A and 7B illustrate views of a roller with a perimetric, tire-location surface with another axial pattern of radial projections. Such a roller may provide a More Stimulating Ride on Riding Vehicles such as, for example, quads and skateboards by replacing the front or rear wheels, or both.

FIG. 7C is a bottom plan view of a schematically shown Riding Vehicle having both front and rear rollers.

Figure 8:
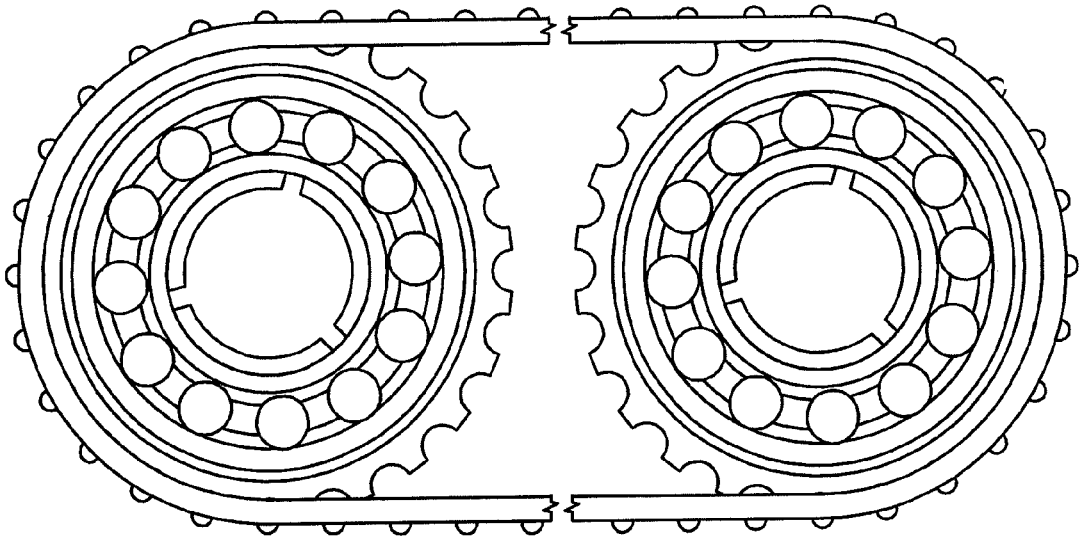
FIG. 8 is an axial elevational view of a pair of wheels according to the embodiment of FIG. 1. having a belt (tread) thereabout with radial projections for cooperation with the grooves of the wheels for the Invention.
Figure 8A:
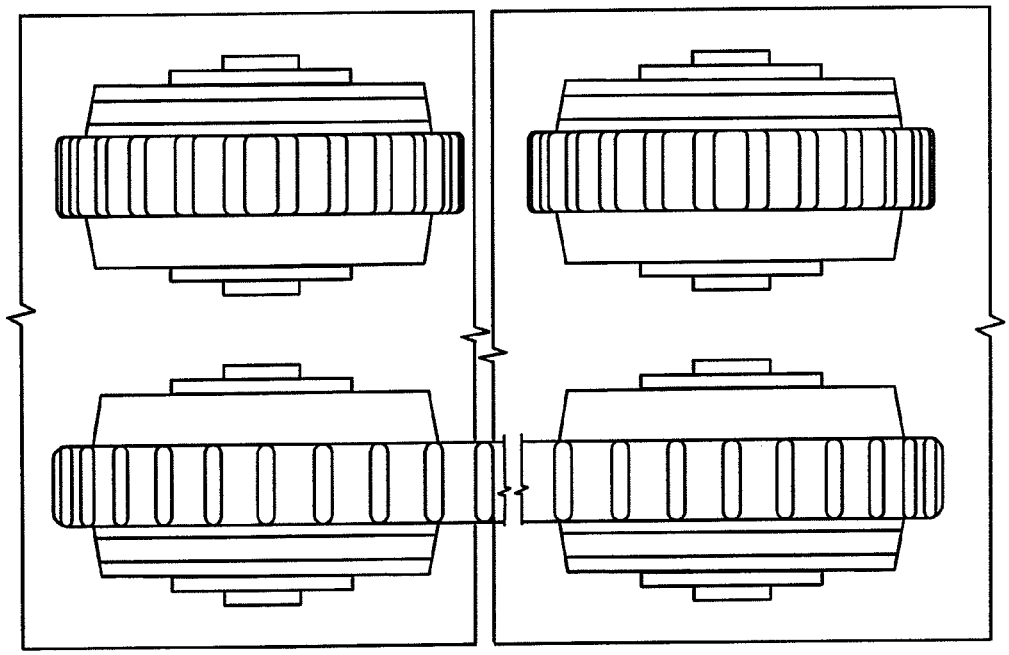
FIG. 8A is a bottom plan view of another schematically shown Riding Vehicle having a left-side pair of the wheels with tread of FIG. 8 at a lower portion of FIG. 8A and a right-side pair of the wheels according to the embodiment of FIG. 1.

FIGS. 8 and 8A illustrate Riding Vehicles with a tractor or tank-like tread connecting the left front and left rear tire and another such tread (not shown in FIG. 8) connecting the right front and right rear tire of, for example, quad skates. Such treads may produce a More Stimulating Ride by, for example, employing axial grooves, as described in FIG. 1, radial projections, as described in FIG. 4, radial projections as described in FIG. 5, or an axial pattern as described in FIG. 6, spaced about the perimeters of both treads.

Figure 9:
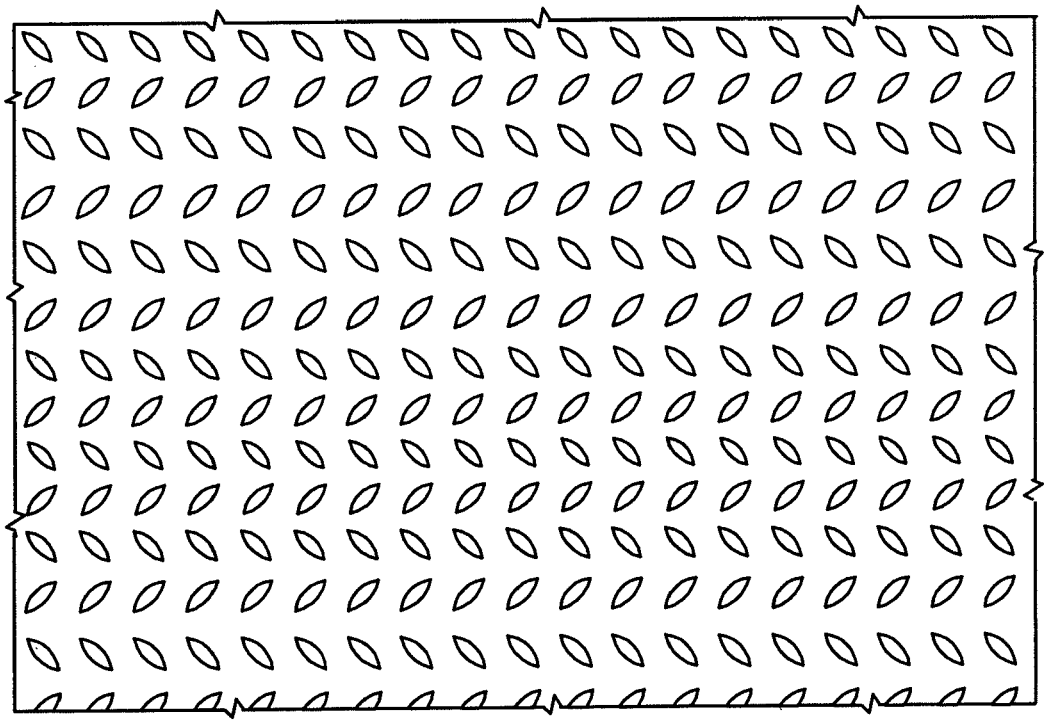
FIG. 9 is a top plan view of a surface for the Invention to provide the effect of the Invention to a Riding Vehicle (not shown) having wheels with smooth perimetric, tire-location surfaces.

FIG. 9 is a top plan view of an example of a Rink or other riding surface that would produce a More Stimulating Ride (and accompanying unique sound pattern) for riders on such conventional Riding Vehicles as, for example, quads or in-line skates. Such Rink or other riding surface may be created by a pattern of closely spaced protruding ribs, shallow grooves, rounded ridges, and the like.

Figure 9A:
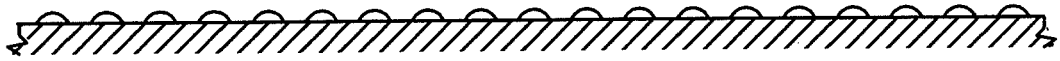
FIG. 9A is a front elevational view of the surface of FIG. 9.

FIG. 9A is another view of FIG. 9.

Figure 10:
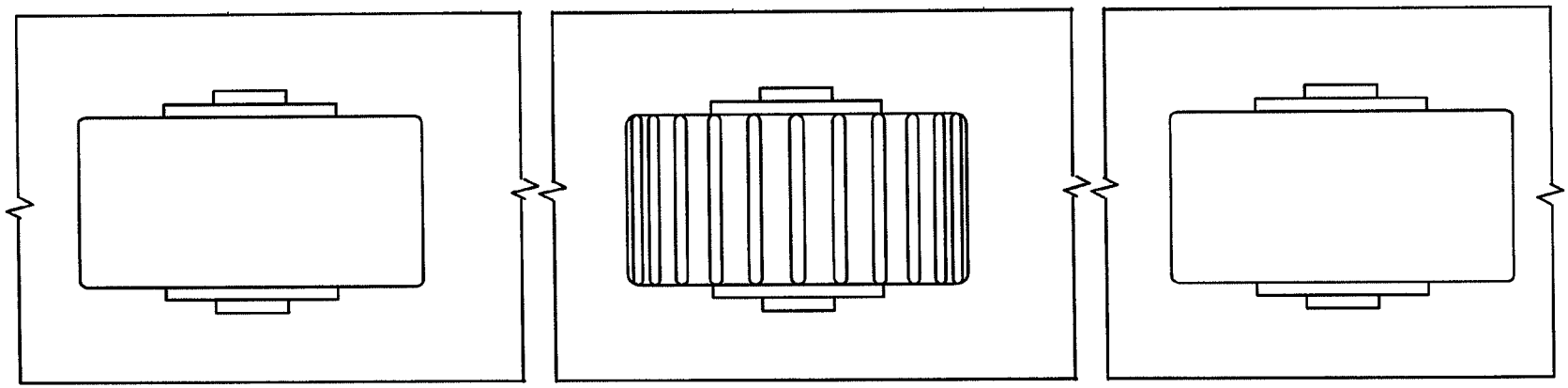
FIG. 10 is a bottom plan view of another schematically shown Riding Vehicle having front, middle and rear in-line wheels, the middle wheel having a perimetric, tire-location surface with one or more axial grooves thereacross for the Invention.

FIG. 10 is a bottom plan view of another schematically shown Riding Vehicle such as, for example, a scooter in which an innovative middle tire with axial grooves has been added to the conventional scooter model. Such innovative tire may be of the kind described in FIGS. 1B, 2B, 3B, 4B, 5B, or 6B designed to deliver a (mildly) More Stimulating Ride, although those referenced in FIGS. 2B and 3B are the preferred embodiments.

Figure 10A:
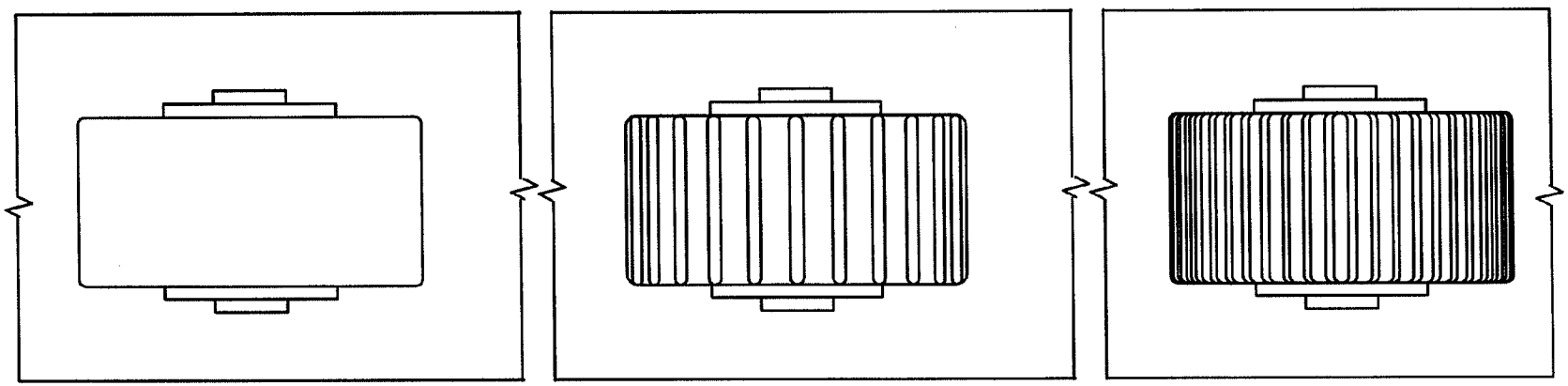
FIG. 10A is a bottom plan view of another schematically shown Riding Vehicle having front, middle and rear in-line wheels, the middle wheel having a perimetric, tire-location surface with one or more axial grooves thereacross for the Invention and the rear wheel having a perimetric, tire-location surface with one or more axial grooves thereacross than the middle wheel for the Invention.

FIG. 10A is a bottom plan view of another schematically shown Riding Vehicle such as, for example, a scooter in which the middle and rear wheels have a different number of axial grooves, which Riding Vehicle will provide a More Stimulating ride of a different intensity.

Figure 11:
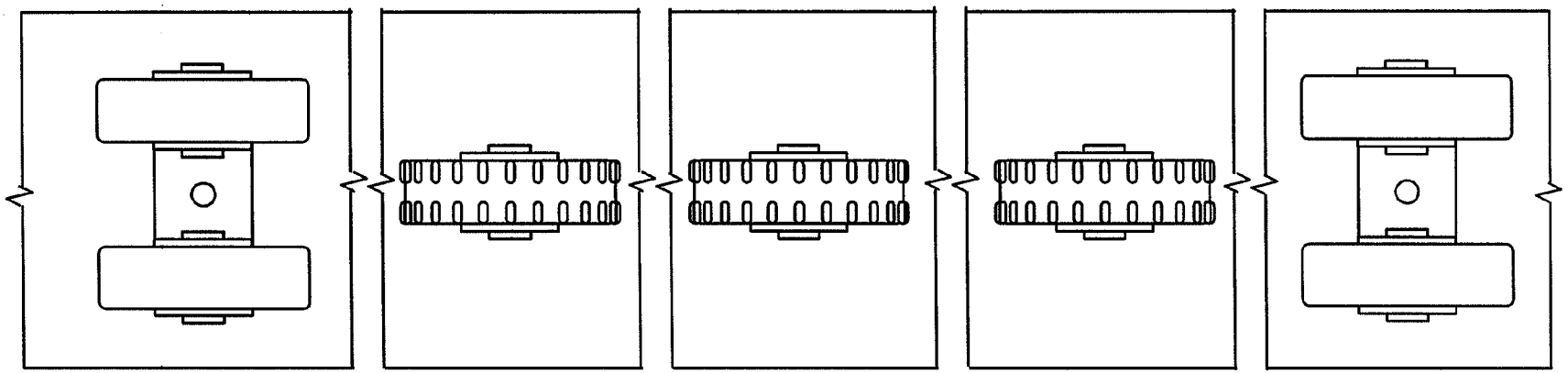
FIG. 11 is a bottom plan view of another schematically shown Riding Vehicle having front and rear pairs of axially spaced wheels in quad arrangement with three in-line wheels therebetween according to the embodiment shown in FIG. 5A.

FIG. 11 illustrates a bottom plan view of another schematically shown Riding Vehicle such as, for example, a skateboard with front and rear pairs of axially spaced conventional skateboard wheels in quad arrangement with the capacity to receive up to three additional innovative tires. FIG. 11 shows an additional three innovative tires according to the embodiment shown in FIG. 5A spaced down the center of the underside of the riding platform. One, two, or three other innovative tires may be substituted such as those described in FIGS. 1A, 2A, 3A, 4A, and 6A.

Figure 11A:
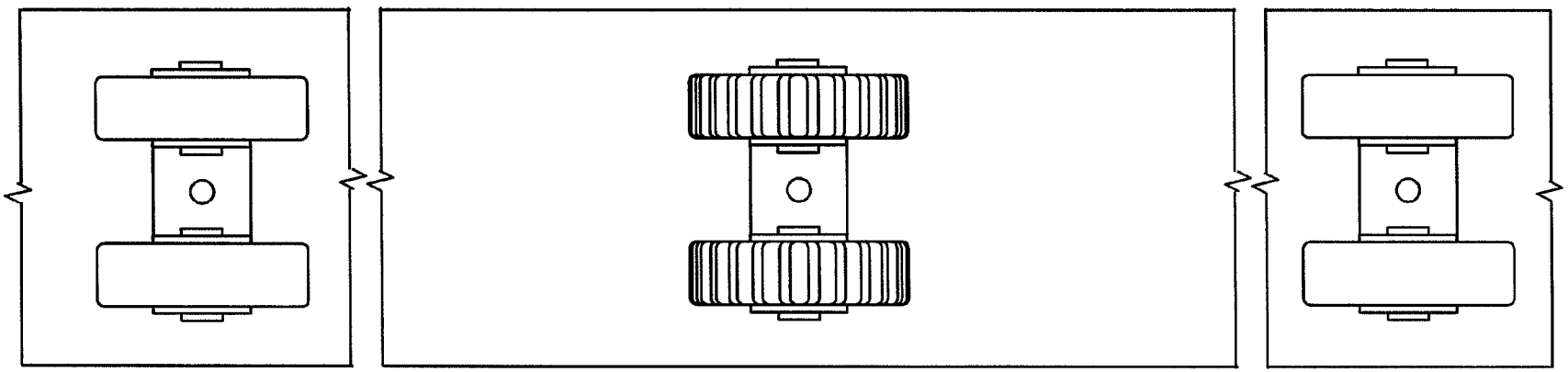
FIG. 11A is a bottom plan view of another schematically shown Riding Vehicle having front and rear pairs of axially spaced wheels in quad arrangement with another pair of axially spaced wheels therebetween having perimetric, tire-location surfaces with one or more axial grooves thereacross as in FIG. 2A for the Invention.

FIG. 11A is a bottom plan view of another schematically shown Riding Vehicle having front and rear pairs of axially spaced wheels in quad arrangement and another pair of axially spaced innovative wheels therebetween having perimetric, tire-location surfaces with axial grooves thereacross as in FIG. 2A. As all of the tires may be caused to be readily attachable and detachable, the rider would have a wide choice of More Stimulating Rides of varying intensity and velocity.

Figure 12:
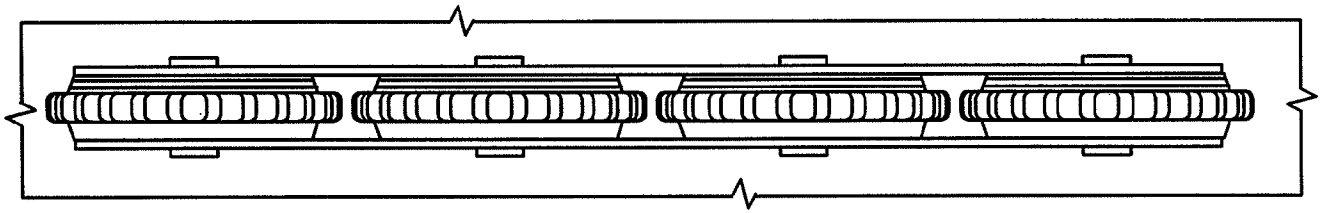
FIG. 12 is a bottom plan view of another schematically shown Riding Vehicle having four in-line wheels with one or more axial grooves thereacross for the Invention.
Figure 12A:
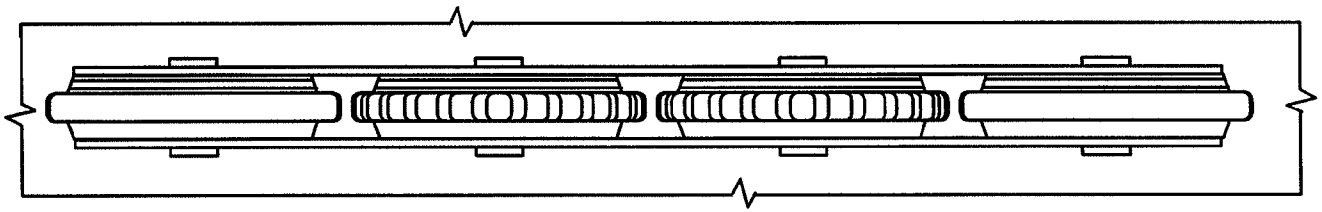
FIG. 12A is a bottom plan view of another schematically shown Riding Vehicle having four in-line wheels, the middle two with one or more axial grooves thereacross for the Invention.
Figure 12B:
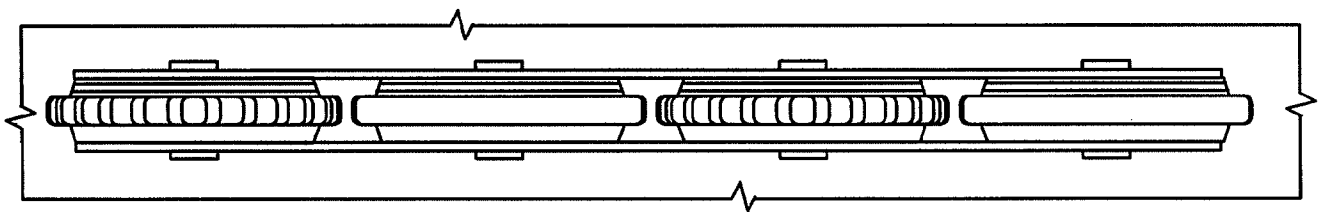
FIG. 12B is a bottom plan view of another schematically shown Riding Vehicle having four in-line wheels, the front and third thereof with one or more axial grooves thereacross for the Invention.

FIG. 12 is a bottom plan view of another schematically shown Riding Vehicle having four Innovative in-line wheels with axial grooves thereacross of the type shown in FIG. 1B for the purpose of delivering a More Stimulating Ride. Fewer innovative wheels than as shown in FIG. 12A or 12B will produce a More Stimulating Ride of differing intensities. Other types of innovative wheels may be substituted for the type shown. As the tires in all of these embodiments, as well as conventional tires, may be interchangeable, a rider may customize his or her ride by employing any combination of such tires on a particular ride.

Figure 13:
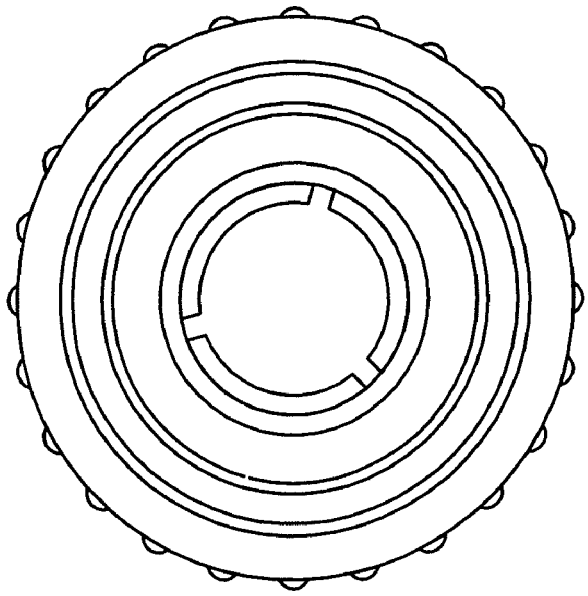
FIG. 13 is an axial elevational view of another embodiment of a wheel with a perimetric, tire-location surface having one or more radial projections on opposite sides thereof and projections rotatable balls as for ball bearings in a channel axially spaced therebetween for the Invention.

FIG. 13 is an axial elevational view of another embodiment of a wheel with a perimetric, tire-location surface having one or more rounded radial projections on the opposite sides thereof and slightly protruding ball bearings axially spaced therebetween that in concert deliver a higher-velocity More Stimulating Ride.

Figure 13A:
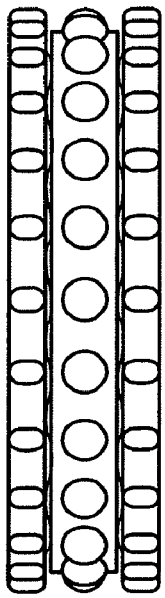
FIG. 13A is a front elevational view of the embodiment of FIG. 13, the rear elevational view being a mirror image and, therefore, not shown and the front and rear elevational views together showing all thereof.
Figure 13B:
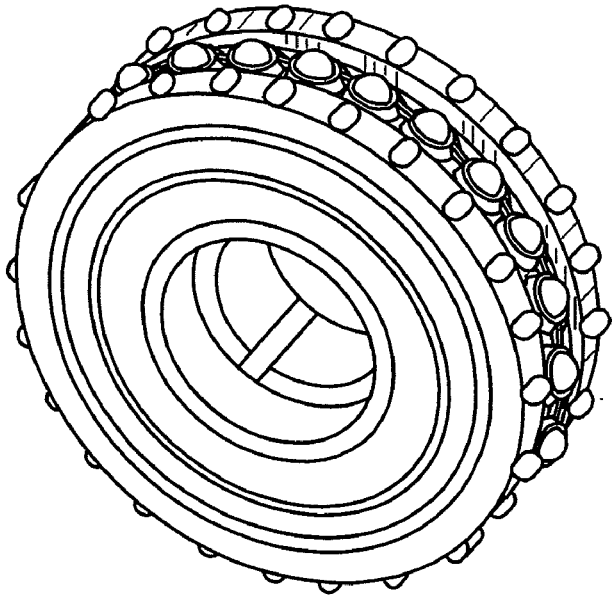
FIG. 13B is a top/right-side/front perspective view of the embodiment of FIG. 13.

FIGS. 13A and 13B illustrate other views of FIG. 13 to show the ball bearings in a recessed holder fixed or rotatable about the wheel.

Figure 14:
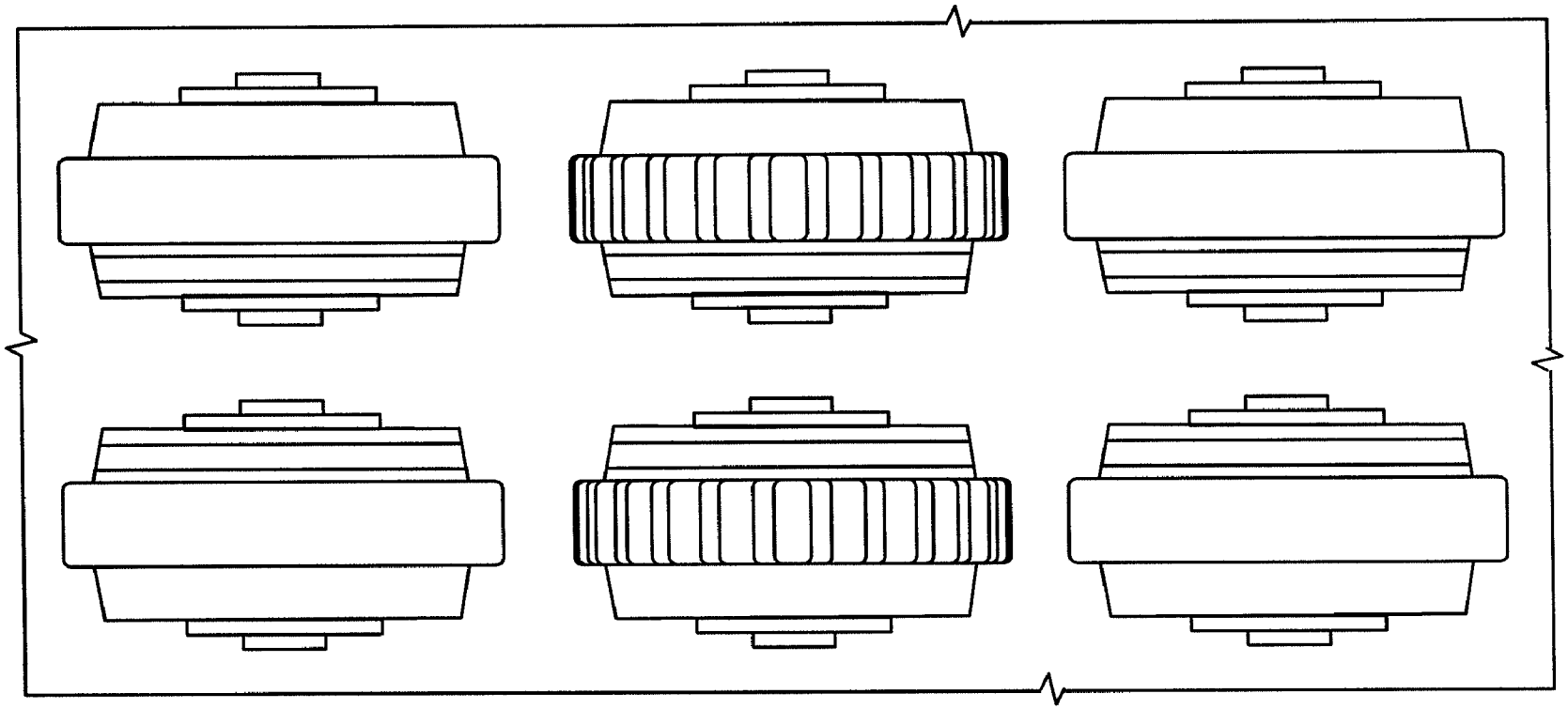
FIG. 14 is a bottom plan view of another schematically shown Riding Vehicle having right- and left-side pairs of front, middle and rear in-line wheels, the middle wheels being, for example, according to the embodiment of FIG. 1A.

FIG. 14 is a bottom plan view of another schematically shown Riding Vehicle (the "Super Quad"), with the front and rear pairs of wheels in quad arrangement (shown here with conventional riding surfaces) and the middle pair as in the embodiment shown in. FIG. 1A. The middle axle and its wheels may be fixed or removable. Several combinations involving up to six innovative wheels are possible in original manufacture or, owing to the readily detachable and attachable feature described herein, to serve the purpose of providing riders a wide choice of More Stimulating Rides.

Figure 15:
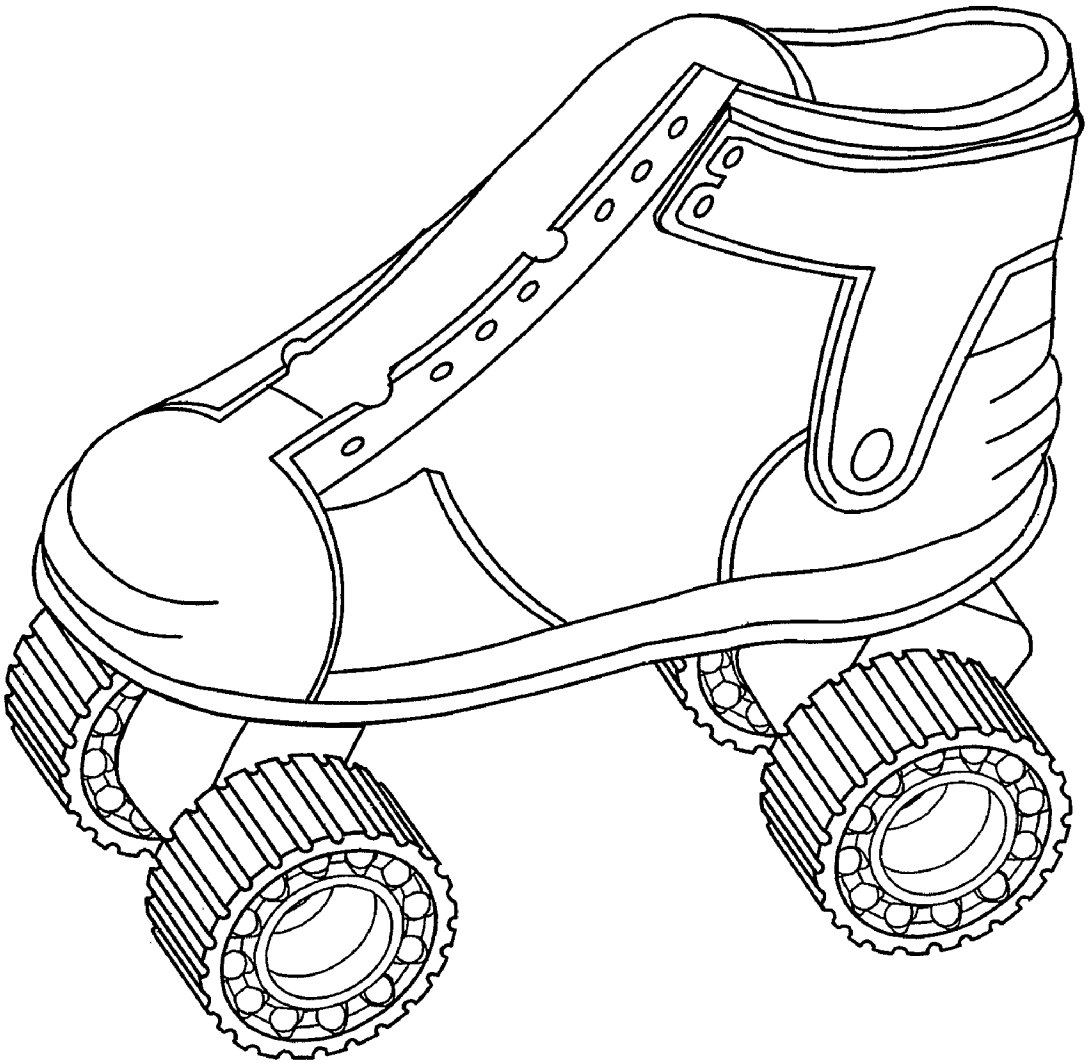
FIG. 15 is a front/top/left-side elevational view of a roller skate with quad wheels according to the embodiment of FIG. 2A.

FIG. 15 illustrates a front/top/let-side elevational view of a quad skate with innovative quad wheels according to the embodiment shown in FIG. 2A. Other innovative wheels may be substituted in lieu of those shown.

The objectives of the Invention may be achieved in a variety of ways. Although the preferred embodiments of the Invention have been disclosed herein, for illustrative purposes by way of example and not by way of limitation, those skilled in the art will appreciate that various modifications, additions and substitutions are possible that will achieve a similar objective or objectives without departing from the scope and spirit of the Invention as disclosed in the accompanying claims.

The accompanying claims of the Invention relate at least to quad and in-line skates, "Super Quads," skateboards, scooters, and other Riding Vehicles that employ or utilize Riding Elements such as, for example, but not by way of limitation, innovative wheels, tires, rollers, ball or roller bearings, spindles, and tank and tractor-like treads, the sounds emitted by such innovative Riding Elements in use, and to an innovative roller-skating Rink or other riding surface on which skaters on conventional quads and in-line skates may enjoy some of the benefits and advantages available to quad and in-line skaters on innovational Riding Elements.

What is claimed is:

1. A non-motorized Riding Vehicle for transport of a rider, the Riding Vehicle consisting essentially of:

(1) support means for supporting at least one foot of a rider;

(2) stimulating means for enabling the Riding Vehicle to roll on a surface and to create a periodic vibration that has a stimulating effect on the rider when the stimulating means is coupled to the support means with the rider transported on the Riding Vehicle; and (3) means for coupling the stimulating means to the support means so that the stimulating means can impart the stimulating effect to the rider during the transport.

2. The Riding Vehicle according to claim 1, wherein the stimulating means comprise a roller that is solid whereby it does not contain air.

3. The Riding Vehicle according to claim 2, wherein the roller is made of metal or plastic.

4. The Riding Vehicle according to claim 3, wherein the Riding Vehicle is a skate and the support means comprises a shoe, and wherein the stimulating effect is an improvement in blood circulation of the rider.

5. A method for increasing bone density of a rider comprising (a) providing the Riding Vehicle of claim 1;

(b) placing at least one foot of a rider into or onto the support means of the Riding Vehicle such that the rider is supported on the Riding Vehicle; and (c) exerting a force to cause the Riding Vehicle to move with the rider supported thereon.

6. The Riding Vehicle according to claim 1, wherein the Riding Vehicle is a non-motorized device selected from the group consisting of an in-line skate, a quad skate, a skateboard and a scooter.

7. The Riding Vehicle according to claim 6, wherein the periodic vibration creates a distinctive, unique, rhythmic, and/or repetitive sound during the transport that will vary with the particular Riding Vehicle, its starts and stops on the surface on which it rides and its variations in velocity.

8. The Riding Vehicle according to claim 7, wherein the sound created by the periodic vibration is at least about 45 decibel at 60 rpm.

9. The Riding Vehicle according to claim 6, wherein the stimulating means comprises a roller with one or more axial grooves around a perimeter thereof.

10. The Riding Vehicle according to claim 6, wherein the stimulating means comprises a roller with one or more of radial projections around a perimeter thereof.

11. The Riding Vehicle according to claim 6, wherein the stimulating means comprises a roller with one or more rounded ridges spaced around a perimeter thereof.

12. The Riding Vehicle according to claim 6, wherein the stimulating means is made of a material selected from the group consisting of plastic, rubber, metal and wood, and wherein the stimulating means is solid in that it does not contain air.

13. A method for improving blood circulation of a rider comprising (a) providing the Riding Vehicle of claim 1;

(b) placing at least one foot of a rider into or onto the support means of the Riding Vehicle such that the rider is supported on the Riding Vehicle; and (c) exerting a force to cause the Riding Vehicle to move with the rider supported thereon.

14. A kit comprising:

(a) a Riding Vehicle having a top portion consisting essentially of a shoe or platform for supporting at least one foot of a rider and a bottom portion comprising axle means for receiving a number n of Riding Elements to facilitate transport of the rider with the rider's foot supported in the shoe or on the platform, wherein n is equal to or greater than 1; and (b) a plurality of Riding Elements, each of which is insertable onto the axle means to facilitate transport of the rider on the Riding Vehicle, said plurality of Riding Elements comprising more than n Riding Elements whereby any of a plurality of different combinations of the n Riding Elements can be inserted onto the axle means, said plurality of Riding Elements comprising first and second Riding Elements, at least the first Riding Element comprising stimulating means for creating a first periodic vibration during the transport such that, when the first Riding Element is included in a combination of n Riding Elements on the axle means, the transport of the Riding Vehicle is less smooth than a transport when the first Riding Element is not included in the combination of n Riding Elements on the axle means.

15. The kit according to claim 14, wherein the second Riding Element comprises second stimulating means for creating a second periodic vibration during the transport, said second periodic vibration having a periodicity or intensity that is different than a periodicity or intensity of the first periodic vibration.

16. The kit according to claim 14, wherein the Riding Vehicle is a non-motorized device selected from the group consisting of an in-line skate, a quad skate, a skateboard and a scooter.

17. A method for changing the intensity of a stimulation of the ride provided by a Riding Vehicle, comprising the steps of:

(a) providing a Riding Vehicle having support means for supporting a rider consisting essentially of a shoe or platform for supporting at least one foot of a rider and at least first and second Riding Elements supporting the support means to facilitate transport of the rider with the rider's foot in the shoe or on the platform; and (b) replacing the first Riding Element of the Riding Vehicle with at least one replacement Riding Element comprising means for creating a periodic vibration such that transport of the rider with the at least one replacement Riding Element replacing the first Riding Element is less smooth than the transport with the first Riding Element without the replacement Riding Element.

18. The method of claim 17, wherein the Riding Vehicle is a non-motorized device selected from the group consisting of an in-line skate, a quad skate, a skateboard and a scooter.

19. The method according to claim 18, wherein the method further comprises replacing said at least one replacement Riding Element or said second Riding Element with a second replacement Riding Element with second stimulating means for creating a second periodic vibration during the transport, said second periodic vibration having a periodicity or intensity that is different than the periodicity or intensity of the first periodic vibration.

* * * * *